US008096035B2

(12) United States Patent
Kelly et al.

(10) Patent No.: US 8,096,035 B2
(45) Date of Patent: Jan. 17, 2012

(54) INSERTED THERMAL BARRIER LINER FOR CONTAINERS

(75) Inventors: Jason Morgan Kelly, Arvada, CO (US); Herbert Bruce Smith, Mississauga, CA (US)

(73) Assignee: MillerCoors, LLC, Golden, CO (US)

( * ) Notice: Subject to any disclaimer, the term of this patent is extended or adjusted under 35 U.S.C. 154(b) by 400 days.

(21) Appl. No.: 12/251,140

(22) Filed: Oct. 14, 2008

(65) Prior Publication Data

US 2009/0095759 A1 Apr. 16, 2009

Related U.S. Application Data

(60) Provisional application No. 60/980,135, filed on Oct. 15, 2007.

(51) Int. Cl.
*B23P 11/00* (2006.01)
*B65D 81/38* (2006.01)

(52) U.S. Cl. ..... 29/428; 29/446; 29/450; 29/464; 220/592.25; 220/592.26; 220/592.01; 220/592.05; 220/592.17; 220/592.2; 220/62.22

(58) Field of Classification Search ..... 29/446, 29/450, 451, 428, 464; 220/592.01, 495.03, 220/23.9, 62.11, 62.12, 62.15, 62.22, 906, 220/592.05, 592.17, 592.2, 592.25, 592.26
See application file for complete search history.

(56) References Cited

U.S. PATENT DOCUMENTS 2,652,148 A 9/1953 Pfeifer
3,494,142 A 2/1970 Beck
3,525,236 A 8/1970 Solhkhah
3,760,972 A 9/1973 McKirnan
3,852,975 A 12/1974 Beck
3,913,770 A 10/1975 Tarro
4,554,189 A 11/1985 Marshall
4,628,703 A 12/1986 Kim
4,671,406 A * 6/1987 Baer ..... 206/315.9
4,736,599 A 4/1988 Siegel
4,761,314 A 8/1988 Marshall
4,784,678 A 11/1988 Rudick et al.
4,802,343 A 2/1989 Rudick et al.
5,168,708 A 12/1992 Siegel (Continued)

FOREIGN PATENT DOCUMENTS

EP 0931998 7/1999

(Continued)

OTHER PUBLICATIONS

U.S. Appl. No. 12/249,356, filed Oct. 10, 2008, Kelly et al.

(Continued)

*Primary Examiner* — Essama Omgba
(74) *Attorney, Agent, or Firm* — Sheridan Ross, P.C.

(57) ABSTRACT

A thermal barrier liner is provided to maintain a beverage within a container at a desired temperature. The thermal barrier liner is installed so as to make intimate contact with the internal surface of the container. According to a method of the invention, the liner is pre-made and mechanically inserted in the container prior to securing the top of the container to the sidewall. A closed cell structure is incorporated in the thermal barrier material. The closed cell structure causes the thermal barrier material to be gas permeable such that voids in the closed cell structure equilibrate with ambient pressure conditions. The voids change size based on changes in ambient pressure conditions as compared to pressure conditions in the thermal barrier material.

15 Claims, 9 Drawing Sheets

U.S. PATENT DOCUMENTS

| | | | | |
|---|---|---|---|---|
| 5,499,460 | A | 3/1996 | Bryant et al. | |
| 5,543,186 | A | 8/1996 | Andersen et al. | |
| 5,637,389 | A | 6/1997 | Colvin et al. | |
| 5,718,352 | A | 2/1998 | Diekhoff et al. | |
| 5,762,230 | A | 6/1998 | Policappelli | |
| 5,928,741 | A | 7/1999 | Andersen et al. | |
| 5,952,068 | A | 9/1999 | Neale et al. | |
| 6,065,634 | A | 5/2000 | Brifcani et al. | |
| 6,103,280 | A | 8/2000 | Molzahn et al. | |
| 6,109,006 | A | 8/2000 | Hutchinson | |
| 6,141,970 | A | 11/2000 | Molzahn et al. | |
| 6,151,911 | A | 11/2000 | Dando et al. | |
| 6,173,579 | B1 | 1/2001 | Davidson | |
| 6,341,491 | B1 | 1/2002 | Paine et al. | |
| 6,387,482 | B1 | 5/2002 | Persiani et al. | |
| 6,415,940 | B1 | 7/2002 | Brabson, II | |
| 6,419,108 | B1 * | 7/2002 | Toida et al. | 220/592.17 |
| 6,422,024 | B1 | 7/2002 | Foye | |
| 6,474,498 | B1 | 11/2002 | Markham | |
| 6,551,638 | B1 | 4/2003 | Dodd et al. | |
| 6,829,902 | B1 | 12/2004 | Claydon | |
| 6,852,381 | B2 * | 2/2005 | Debraal et al. | 428/34.2 |
| 7,074,466 | B2 | 7/2006 | DeBraal et al. | |
| 7,124,604 | B2 | 10/2006 | Taylor et al. | |
| 7,176,426 | B2 | 2/2007 | Ramirez | |
| 2002/0150657 | A1 | 10/2002 | Farr et al. | |
| 2004/0105923 | A1 | 6/2004 | O'Connell | |
| 2004/0109928 | A1 | 6/2004 | O'Connell | |
| 2005/0147778 | A1 | 7/2005 | Tai et al. | |
| 2005/0196629 | A1 | 9/2005 | Bariatinsky et al. | |
| 2005/0258250 | A1 | 11/2005 | Melick et al. | |
| 2006/0038293 | A1 | 2/2006 | Rueger et al. | |
| 2006/0054622 | A1 | 3/2006 | Agnello | |
| 2006/0063000 | A1 | 3/2006 | Tokumara et al. | |
| 2006/0073298 | A1 | 4/2006 | Hutchinson et al. | |
| 2006/0086745 | A1 | 4/2006 | Morrison | |
| 2006/0147696 | A1 | 7/2006 | Crowley | |
| 2006/0153956 | A1 | 7/2006 | Ullmann | |
| 2006/0156756 | A1 | 7/2006 | Becke | |
| 2006/0182165 | A1 | 8/2006 | Tapelt-Glaser | |
| 2006/0182372 | A1 | 8/2006 | Fadal et al. | |
| 2006/0185372 | A1 | 8/2006 | Conde Hinojosa | |
| 2006/0186125 | A1 | 8/2006 | Tew | |
| 2006/0249949 | A1 | 11/2006 | Fortune | |
| 2006/0280843 | A1 | 12/2006 | Jager et al. | |
| 2007/0000484 | A1 | 1/2007 | Magill et al. | |
| 2007/0059837 | A1 | 3/2007 | Heilmann et al. | |
| 2007/0071680 | A1 | 3/2007 | Ribi | |
| 2007/0138289 | A1 | 6/2007 | Melick et al. | |
| 2007/0212501 | A1 | 9/2007 | Wolfe et al. | |
| 2008/0043804 | A1 | 2/2008 | Goldsmith et al. | |
| 2008/0121728 | A1 | 5/2008 | Rodriguez | |

FOREIGN PATENT DOCUMENTS

| | | |
|---|---|---|
| EP | 1780147 | 5/2007 |
| GB | 2347202 | 8/2000 |
| GB | 2365106 | 2/2002 |
| GB | 2370629 | 7/2002 |
| JP | 2007-090071 | 4/2007 |
| WO | WO 95/04709 | 2/1995 |
| WO | WO 97/24968 | 7/1997 |
| WO | WO 2004/022435 | 3/2004 |
| WO | WO 2004/037888 | 5/2004 |
| WO | WO 2005/102668 | 11/2005 |

OTHER PUBLICATIONS

U.S. Appl. No. 12/249,431, filed Oct. 10, 2008, Willcoxen et al.

"Phase Change Material", Answers.com (Technology), available at http://www.answers.com/topic/phase-change-material-1?cat=technology, printed on Aug. 29, 2007, pp. 1-2.

"Encapsulated Phase Change Materials", microtek Laboratories, Inc., available at http://www.microteklabs.com/phasechange.html, printed on Aug. 29, 2007, p. 1.

"Micro PCM's", microtek Laboratories, Inc., available at http://www.microteklabs.com/micropcm.html, printed on Aug. 29, 2007, p. 1.

"n-Paraffin Technical Data Sheet (Complex Normal Paraffin)", microtek Laboratories, Inc., available at http://www.microteklabs.com/table.html, printed on Aug. 29, 2007, p. 1.

International Search Report for International (PCT) Patent Application No. PCT/US08/79844, mailed Feb. 6, 2009.

Written Opinion for International (PCT) Patent Application No. PCT/US08/79844, mailed Feb. 6, 2009.

International Preliminary Report on Patentability for International (PCT) Patent Application No. PCT/US08/79844, mailed Apr. 29, 2010.

Heilman, "Camera Phone Based Indicator," Research and Development Activities in Printed Intelligence, H. Kopola, ed., 2009, VTT Technical Research Center of Finland, pp. 26-27, available at http://130.188.4.36/files/download/scientific_reports/cpi_09_review.pdf#page=27.

U.S. Appl. No. 13/042,112, filed Mar. 7, 2011, Kelly.

* cited by examiner

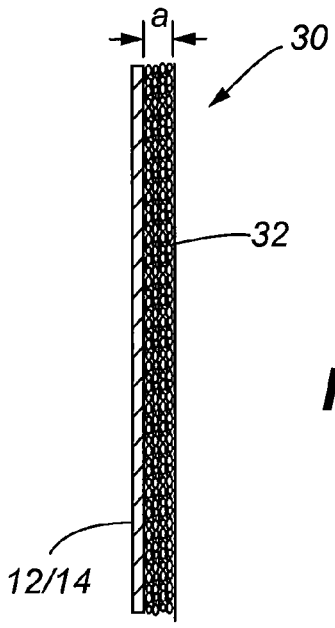
Fig. 2
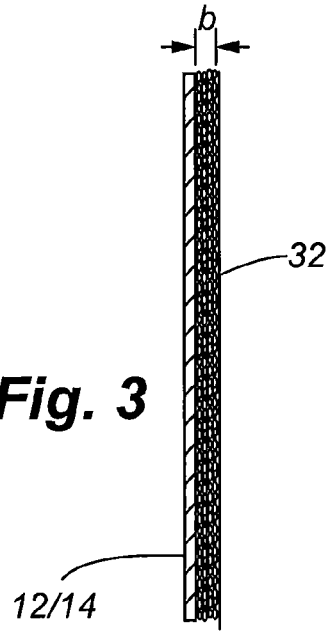
Fig. 3
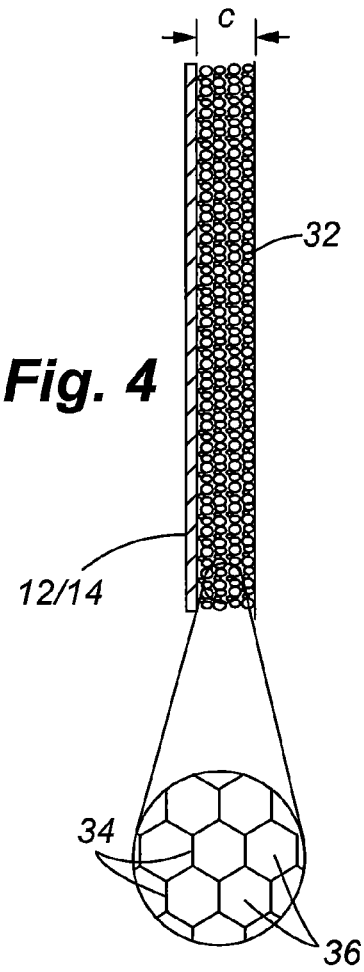
Fig. 4
Fig. 4A
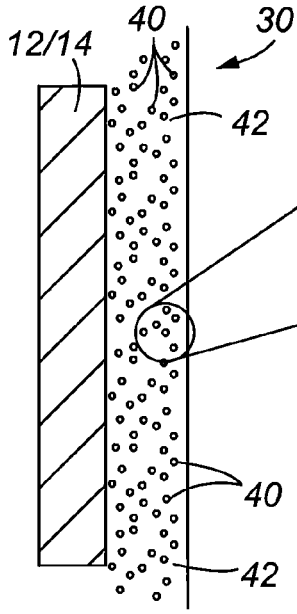
Fig. 5
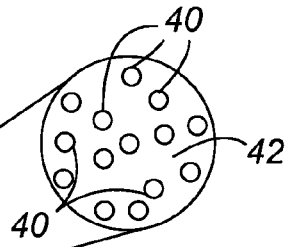
Fig. 5A
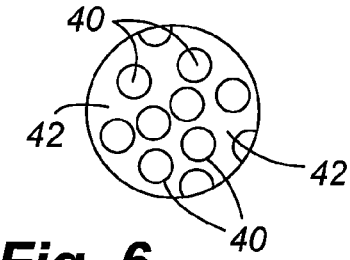
Fig. 6

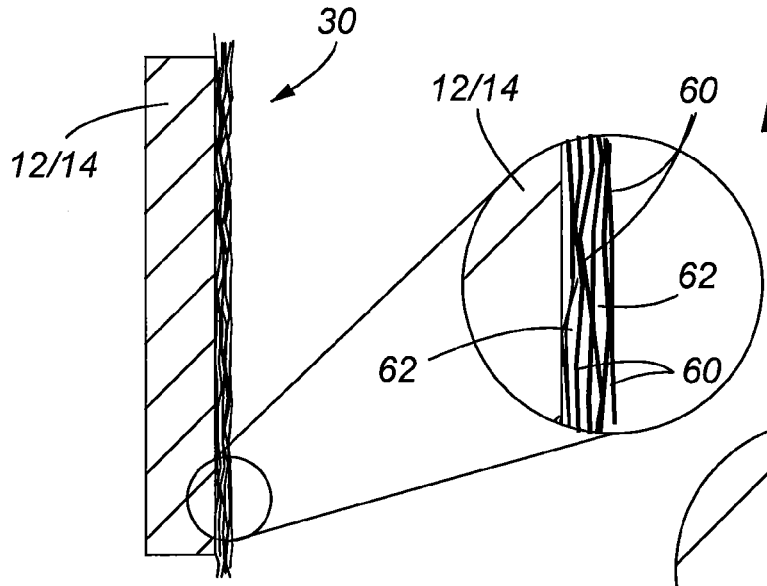
Fig. 9A
Fig. 9
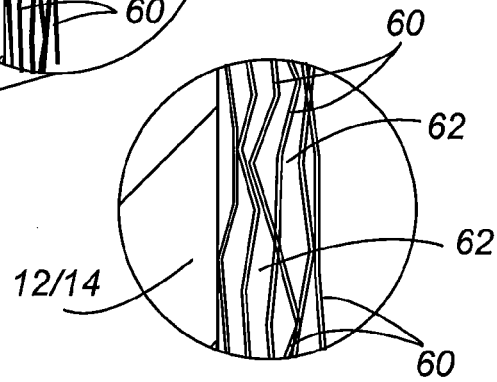
Fig. 10
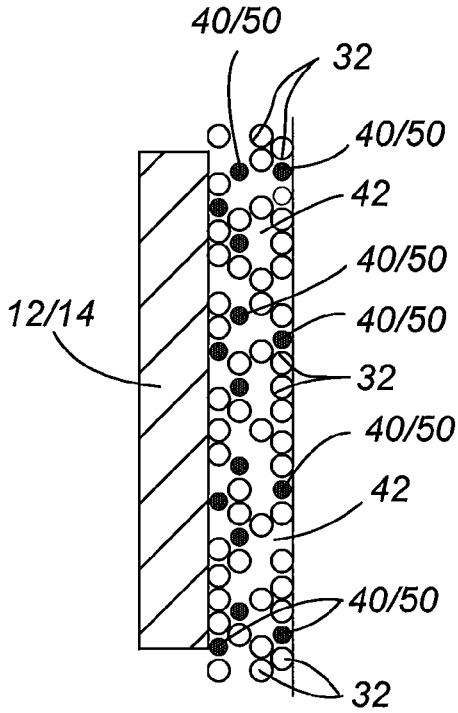
Fig. 11

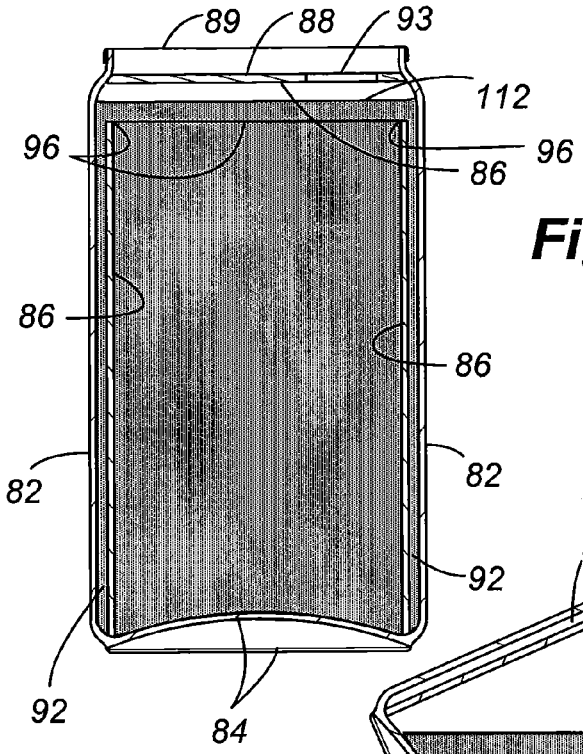
Fig. 18
Fig. 19
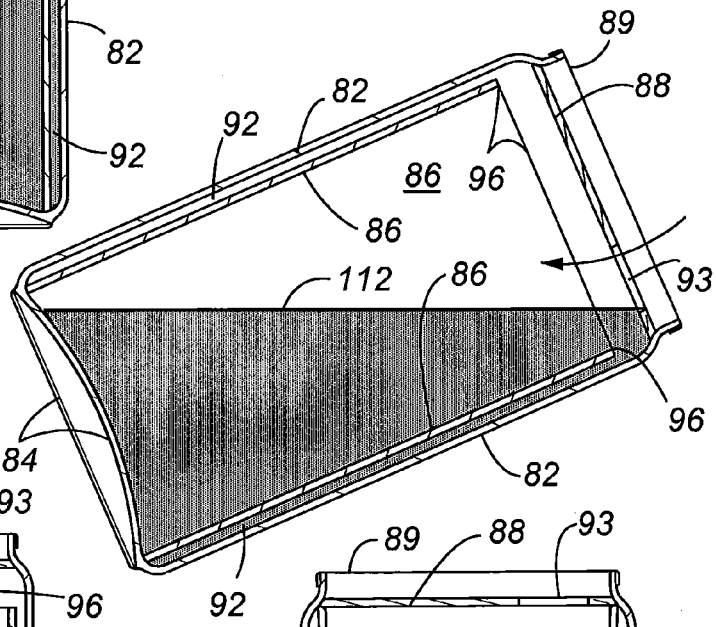
Fig. 20
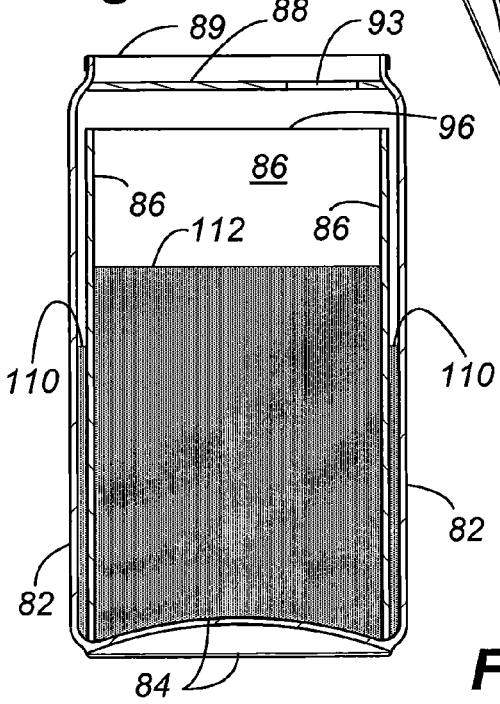
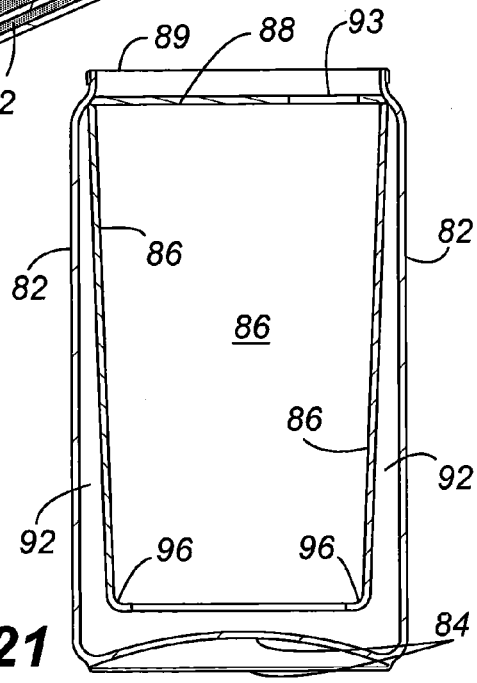
Fig. 21

INSERTED THERMAL BARRIER LINER FOR CONTAINERS

CROSS REFERENCE TO RELATED APPLICATIONS

Priority is claimed from U.S. Provisional Patent Application No. 60/980,135 filed on Oct. 15, 2007, entitled "INSERTED THERMAL BARRIER LINER FOR CONTAINERS", which is incorporated herein in its entirety by this reference.

FIELD OF THE INVENTION

The present invention relates to a thermal barrier liner for containers, and more particularly, to a thermal barrier liner placed in contact with the inner surface of the container and a method of installing the liner by mechanically inserting the liner in the container.

BACKGROUND OF THE INVENTION

Portable beverage containers are used to hold many types of beverages to include carbonated soft drinks, fruit drinks, and beer. It is well known to provide a protective internal liner for those containers made of metal such as aluminum or steel to help preserve the beverage within the container by preventing undesirable chemical reactions that would otherwise take place over time by direct contact of the beverage with the metallic container. For containers made of plastic, there is typically no internal liner provided because the plastic material is inherently non-reactive with respect to most types of beverages.

Many beverages are preferably consumed at relatively cold temperatures, for example, between about 36° F. and 50° F. For carbonated soft drinks and beer, consumers typically prefer these beverages to be chilled prior to consumption. Traditional chilling or cooling techniques include placing the containers in a chilled environment such as a refrigerator or cooler, and then serving the beverage once the beverage has reached a desired chilled temperature.

When the beverage is removed from the chilled environment, the beverage begins to quickly warm due to a combination of external heat sources including ambient heat of the surrounding environment, contact with warm surfaces such as the consumer's hand or the surface on which the container is placed, as well as radiant heat from the sun or other light sources. Heat transfer takes place through the walls, base, and top of the container to the beverage. Without some means provided for insulating the container, the beverage so quickly warms that, in many circumstances, it becomes undesirable or unfit for consumption.

There are a number of inventions that have been developed for purposes of insulating a beverage within the container such that it is maintained at a desired temperature prior to and during consumption. For example, it is well known to provide external thermal barriers, such as an insulating sleeve that is applied over the exterior sidewall of the container. It is also known to provide an insulated label on the sidewall of the container. There are a number of disadvantages to these traditional methods of insulating beverages. An insulating label/sleeve only covers the container sidewall, therefore leaving the bottom of the container exposed. For insulated labels, they are typically much thicker than a non-insulated label and, therefore, standard packaging line may have to be substantially modified to accommodate these special labels. For insulating sleeves, these require the consumer to maintain a separate component to maintain the beverage at a desired cold temperature.

Some efforts have been made to provide an internal insulating liner for containers. One example is disclosed in U.S. Pat. No. 6,474,498. This reference discloses a thermally insulated container for canned beverages including a lining formed from a plastics material. The preferred embodiments suggest using a plastic closed cell material to include closed cell material similar to bubble wrap. The liner is intended to be placed into the container as by a slidable fit within the container so as to be in contact with the cylindrical inner surface of the container wall. The lining member may include an adherent surface allowing the lining to adhere to the internal wall of the container. In an alternative embodiment, this reference discloses a closed cell material that can be provided as a layer on the interior surface of the metal container in addition to or in place of a conventional lacquered coating applied to the interior surface of the container.

U.S. Patent Application Publication No. 2006-0073298 discloses a multi-layer inner liner provided for a container and an extrusion method for a beverage container. The method contemplates blow molding the inner liner by co-extrusion of a first inner layer of a thermoplastics material and a second inner layer made of a foam material having insulating properties. The inner layer of foam is further disclosed as having micro-spheres that expand during the blow-molding process.

U.S. Patent Application Publication No. 2006-0054622 discloses an insulated beverage container having an inner liner that adheres to the inside of the container. The inner liner is made from a crystalline ceramic material.

While the foregoing references may be adequate for their intended purpose, there is still a need for an internal thermal barrier to maintain a beverage at a desired temperature wherein the thermal barrier can be incorporated within a liner installed by using standard packaging machinery.

SUMMARY OF THE INVENTION

It is one object of the invention to provide a thermally insulated beverage container that can effectively and safely keep beverages at a desired temperature during consumption of the beverage.

It is yet another object of the present invention to provide a thermally insulated beverage container by providing a thermal barrier liner utilizing a single material that exhibits specific common desirable properties resulting in creation of an insulated thermal barrier.

It is yet another object of the present invention to provide a unique combination of materials that, when combined, exhibit desirable thermal barrier properties.

It is yet another object of the present invention to provide a method of installing a thermal barrier, such as a mechanically inserted thermal barrier liner having the form of a sheet-like substrate.

It is yet another object of the present invention to provide a thermal barrier that can be used in different types of beverage containers, such as those made from metal or made from plastic.

It is yet another object of the present invention to provide a thermally insulated beverage container that can be introduced into existing beverage manufacturing, distribution, and sales sectors without requiring significant alterations in manufacturing machinery or processes.

In accordance with the present invention, a thermally insulated beverage container is provided having a thermal barrier liner positioned in contact with inner surface of the container. The container of the present invention may include any known beverage container, such as those made from aluminum or steel that holds beverages such as beer or carbonated soft drinks. The container of the present invention may further include known plastic containers, such as PET bottles or cans.

In a first embodiment of the present invention, the thermal barrier liner may include use of a single material having a cell structure comprising a plurality of voids or pockets and wherein the liner covers the interior surface of the container to include the container sidewall and base of the container. In this embodiment, the liner may also be referred to as a closed cell substrate layer or foam layer. The material used for the barrier liner in this embodiment has a stretchable or elastic capability such that the voids may increase in physical size without rupturing. The particular liner material and manner of installing the liner can be selected such that the cell sizes create a thermal barrier liner of a desired thickness when the container is opened. The thickness of the barrier liner as well as the composition of the barrier liner in terms of the amount of void spaces within the liner can also be adjusted to optimize the thermal barrier liner for purposes of insulating the beverage. The thermal barrier liner may be made from a cavitated or extruded monolayer film substrate containing gas permeable closed cells. The thermal barrier liner could also be made by combining different materials. For example, two rolls of formed material can be laminated together through the use of adhesives of heat and pressure. One or both materials could incorporate cell structures and when combined, the materials form an integral thermal barrier liner. Further, the thermal barrier liner could be made in a co-extrusion process or a post extruded process. In a co-extrusion process, the materials could be combined by heat and pressure as extrudate is generated from an extruding device, or the materials can be laminated to one another with some assistance from heat and pressure but also from an applied adhesive. In other embodiments of the present invention, the thermal barrier liner includes a base material containing encapsulated gases or phase change materials. The encapsulated gases or phase change materials are dispersed throughout the base layer. In these embodiments, the base material can be made from a laminated, extruded, or coated film structure.

In another embodiment of the present invention, the thermal barrier liner includes a combination of materials that, when combined, exhibit thermal barrier properties. This embodiment may be referred to as a composite liner including a combination of: (i) a cell structure comprising a plurality of voids or pockets; (ii) microencapsulated gases; and/or (iii) microencapsulated phase change materials. In this embodiment, the base material can also be made from a laminated, extruded, or coated film structure including a desired dispersion of gas permeable closed cells.

In another embodiment of the present invention, an interior liner is provided that is offset or spaced from the interior surface of the wall of the container. This liner has one end secured to either the top or bottom/dome of the container and is sealed to the top or bottom to prevent gas and liquid flow through the area of connection. The other end of the liner remains unattached and is spaced from the top or bottom of the container depending on which end of the liner is attached. When the container is filled and prior to consumption, a small amount of gas is trapped in this annular gap along with liquid that fills the container. When the container is opened for consumption, the container is tipped so that the beverage can be poured from the container.

If the liner is secured to the top of the container, the unattached lower end is spaced from the bottom of the container. When the container is tipped to a sufficient angle, the unattached lower end of the liner is not submerged in the beverage therefore exposing a portion of the annular gap to the air. When the container is returned to its upright position after the user has poured an amount of the beverage, the unattached end is re-submerged in the beverage thereby trapping air in the annular gap. The trapped air results in the creation of a thermal barrier to keep the beverage cool.

If the liner is secured to the bottom of the container, the unattached upper end is spaced from the top of the container and when the container is tipped to a sufficient angle, the beverage will be poured from the annular gap thus evacuating an amount of liquid in the annular gap and the liquid being replaced by air since the gap is exposed to the air. The liner then acts as a dam to prevent liquid from migrating back into the annular gap.

In either way in which the liner is installed in the container, an increased volume of gas in the annular gap results in the creation of an air barrier that serves as an effective thermal barrier to keep the beverage at the desired temperature for consumption.

In yet another embodiment, the liner can be made from a mesh material wherein the material has a pattern of voids or gaps. When the container is opened, the gas bubbles from nucleation will cling to the mesh creating a concentration of gas bubbles on the material. The concentrated gas bubbles form an effective thermal barrier to prevent heat transfer to the beverage within the container. The mesh may have voids or gap sizes that allow the beverage to easily pass through the liner, or the mesh material may have very small voids that somewhat restrict the flow of the beverage through the liner. The void sizes can be selected to optimize the ability of the bubbles to attach to the liner. Other ways in which to maximize the concentration of bubbles on the liner is to provide a surface treatment/modification wherein the mesh material has surface properties that encourage the formation and retention of bubbles thereon. For example and as discussed below in reference to the preferred embodiments, the surface of the liner could be irregular or textured which greatly assist in the retention of bubbles on the surface of the liner.

In order to increase the amount of gas that is able to fill the annular gap for the embodiment in which the unattached end is at the lower end of the container or in order to maximize the gas bubbles that attach to the mesh liner, the liner may incorporate a material that enhances nucleation of the gas in the beverage. Another option available for increasing the amount of gas to fill the annular gap or to create a bubble layer on the liner is to place a conventional widget in the container. A widget is used in some malt beverage containers to increase the rate of de-gassing of the beverage thus creating a more robust head when the beverage is served. A widget used in the present invention creates a greater number of bubbles that can attach to the liner.

In yet another embodiment of the present invention, a thermal barrier liner may be provided in the form of a multi-layer coating construction wherein voids or gas pockets are found between the layers thereby providing an effective thermal barrier. In this embodiment, a co-extrusion lamination process can produce the multi-layer coating where portions of adjacent layers are sealed to one another while other portions are not sealed thus creating the gas pockets or void areas between the layers.

In yet another aspect of the present invention, a method is provided for installing the thermal barrier liner to the interior surface of a beverage container. The liner is preferably in sheet form, but incorporating the various insulating features.

The thermal barrier liner is preferably pre-made and stored in a continuous roll of material. The roll is unwound near the area in the manufacturing process where the liner is to be mechanically installed into the beverage container. The roll of barrier material is cut into predetermined sized pieces and placed within respective containers such that the liner material maintains contact with the interior sidewall of the containers.

The thermal barrier liner in the first embodiment of the present invention is gas permeable thus having the ability to equilibrate with ambient pressure conditions. More specifically, during the application of the liner to the container, the voids or pockets formed in the liner will contain gas of the surrounding environment, and the ambient pressure will determine the void sizes. After the container has been filled and sealed, the interior of the container develops a higher pressure in which the void areas further fill with gas contained in the container, such as carbon dioxide or nitrogen. This gas resides in the headspace and the gas can also be found dissolved in the beverage if the beverage is carbonated. Since the container is under pressure, the voids may decrease in size as compared to the size of the voids under ambient pressure conditions; however, the voids will contain a greater amount of gas due to the higher pressure conditions in which equilibrium is reached and pressure across the liner is equal. The voids fill with the gas (es) over a relatively short period of time due to the gas permeable nature of the liner material.

Once the container is opened, the thermal barrier liner transitions to equilibrium with ambient pressure wherein the pressurized gas contained within the voids causes an immediate expansion of the size of the voids. The increased size of the voids creates a thickened liner that is an effective thermal barrier liner to maintain beverage at a desired temperature.

Other features and advantages of the present invention will become apparent from a review of the following detailed description, taken in conjunction with a review of the drawings.

BRIEF DESCRIPTION OF THE DRAWINGS

FIG. 2 is an enlarged fragmentary cross section view of the thermal barrier liner of the present invention in a first embodiment characterized by a closed cell substrate layer or foam layer;

FIG. 3 is another enlarged fragmentary cross section of the embodiment of FIG. 2 showing the closed cell substrate layer after the container has been sealed and pressurized;

FIG. 4 is another enlarged fragmentary cross section view of the first embodiment after the container has been opened resulting in expansion of the liner;

FIG. 4A is a greatly enlarged view of a portion of FIG. 4 showing the structure of the substrate layer after the container has been opened;

FIG. 5 is an enlarged fragmentary cross section of a barrier liner in another embodiment of the present invention comprising microcapsules containing encapsulated gas or liquid embedded in a base liner material;

FIG. 5A is a greatly enlarged view of a portion of FIG. 5 showing the barrier liner and gas or liquid filled microcapsules;

FIG. 6 is another greatly enlarged view of the portion of FIG. 5 when liquid filled microcapsules are used and undergo a phase change to a gas upon warming and wherein the microcapsules expand in the gaseous state;

FIG. 9 is an enlarged fragmentary cross section view of another embodiment of the present invention illustrating a thermal barrier liner constructed of a multi-layer configuration and illustrating the container when sealed and pressurized;

FIG. 9A is a greatly enlarged view of the embodiment of FIG. 9 showing the multi-layer configuration when the container is sealed and pressurized;

FIG. 10 is another greatly enlarged view of the embodiment of FIG. 9 illustrating the container after it has been opened and expansion in thickness of the liner;

FIG. 11 illustrates yet another embodiment of the present invention in the form of a composite thermal barrier liner including a combination of features of the prior embodiments including a closed cell substrate, and encapsulated gas and/or encapsulated phase change material set within a base liner;

FIG. 18 is another cross section view illustrating a liner in accordance with the embodiment of FIG. 15; however the liner is sealed to the bottom of the container and the upper end of the liner is unattached and spaced from the top of the container;

FIG. 19 is another cross section view of the embodiment of FIG. 18 illustrating the container being tipped allowing air to enter the annular gap as the beverage is poured from the gap;

FIG. 20 is another cross section view of the embodiment of FIG. 18 illustrating the container when returned to an upright position and an enhanced thermal barrier being created by the air replacing the liquid in the annular gap;

FIG. 21 is a cross section view illustrating a liner in accordance with the embodiment of FIG. 15 that does not extend parallel with the sidewall of the container and rather, extends at an angle with respect to the sidewall;

DETAILED DESCRIPTION

Figure 1:
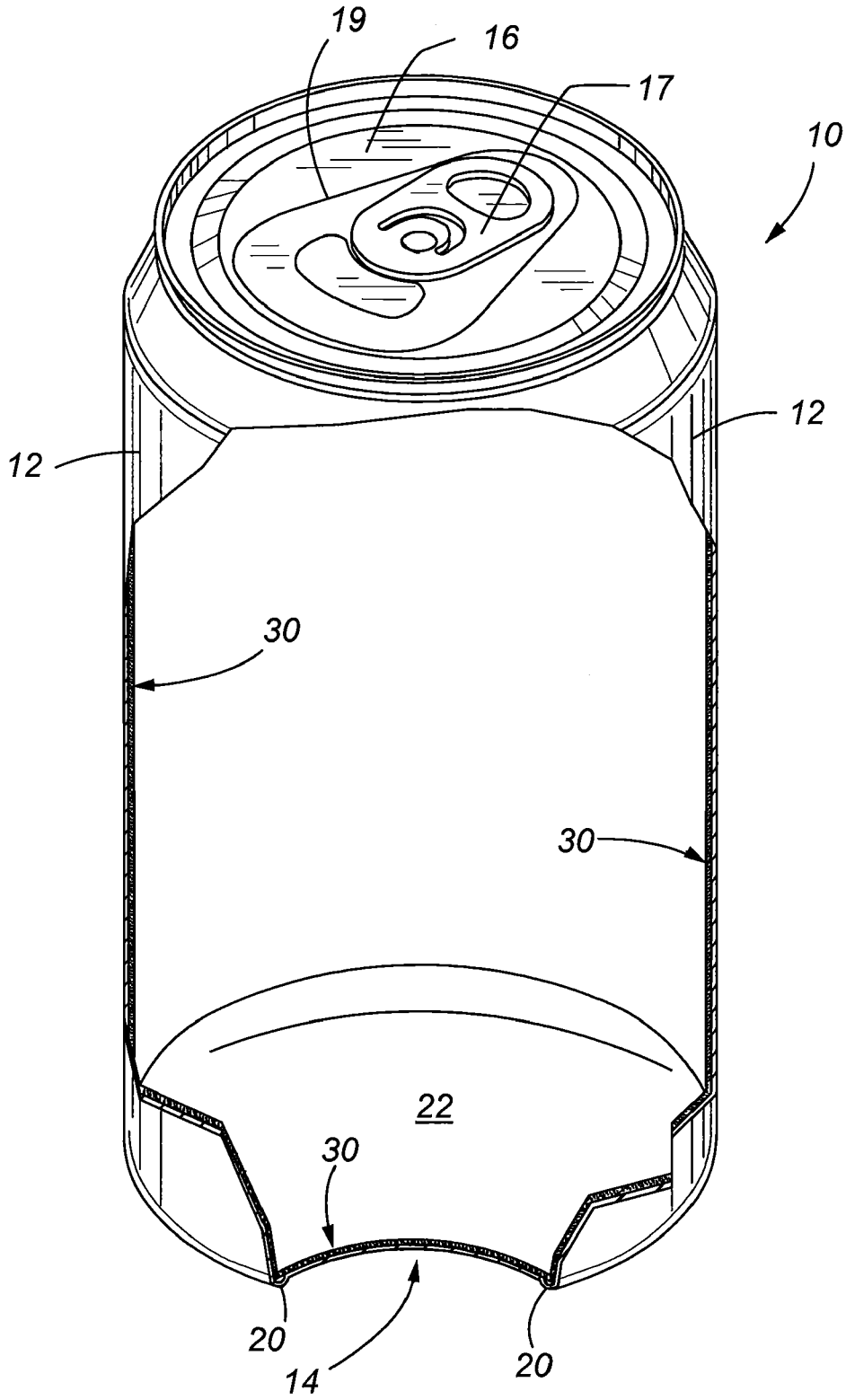
FIG. 1 is a fragmentary perspective view of a beverage container incorporating a thermal barrier liner of the present invention.

With reference to the drawings, FIG. 1 shows a beverage container 10, particularly suited for beverages such as beer or carbonated soft drinks, fruit drinks, and like. The container is illustrated as a conventional beverage can having a sidewall or body 12, a base 14, and an openable top 16. The openable top 16 may include a closure mechanism, such as a pull-tab 17. The sidewall or body of the container is constructed of conventional materials such as aluminum or steel. The openable closure mechanism 17 is also preferably aluminum or steel and may include the pull-tab 17 that contacts a scored area 19 on the top 16. Activation of the pull-tab 17 breaks the scored area 19 creating an opening or mouth to provide access to the beverage inside the container. As also shown in FIG. 1, the conventional container may include the bottom or base 14 having an annular lip 20 and a dome shaped panel 22.

In accordance with a first embodiment of the present invention, a thermal barrier liner 30 is provided as shown in FIGS. 1-4. The thermal barrier liner in this first embodiment comprises a gas permeable closed cell substrate 32. The substrate 32 is installed so that the liner contacts the interior surface of the container. The gas permeable closed cell substrate includes a pattern of cells 34 defining a plurality of voids, gaps, or open spaces 36 thereby providing the appearance of a foam layer. FIG. 2 illustrates the substrate 32 after the substrate has been installed in the container and positioned in contact with the interior surface of the container. The voids or gaps may be of an irregular pattern and the voids or gaps may be of different sizes and shapes. In one aspect of the first embodiment, the thermal barrier liner material may be made from a homogenous material. In another aspect of the first embodiment, the thermal barrier liner may include a combination of materials. In either case, the liner is gas permeable and the cells 34 have walls that are elastic/elastomeric such that the overall size of each of the voids/gaps 36 can change according to ambient pressure conditions.

The arrangement and size of the voids/gaps 36 may be a result of either how the liner 30 is manufactured and/or may be determined during a curing process wherein the voids/gaps form over a period of time. For example during manufacture of the liner, the liner can be oven dried to evaporate any solvents or other compounds used. Curing can also be conducted to condition the state of the microencapsulated gas, liquid, or solid materials used in order to place them in the best state prior to filling and sealing the container. The void areas may be randomly dispersed and randomly sized. However, depending upon the material used as the liner, a more orderly cellular pattern may result. The percentage of void or open cell space volume can range between about 10 to about 95 percent of the overall volume of the thermal barrier liner.

One important attribute of the substrate 32 is that it be gas permeable such that when placed under pressure, the substrate will equilibrate resulting in a substantially uniform distribution of gas within the voids 36. Furthermore, when pressure is reduced, the substrate should have the capability to expand such that the cell walls 34 do not burst, tear, or otherwise degrade and, rather, will maintain an inflated state for a period of time thus creating an effective thermal barrier liner realized by the increased volume of the substrate 32.

It has been found through testing that some existing container liner materials have the capability to be formed into foamed substrates and are elastic such that the substrate maintains integrity among various pressure ranges. However, in order to optimize the closed cell substrate configuration and necessary gas permeability, foaming agents can be added to the liner materials. The liner materials can include polymeric or synthetic formulations of thermoplastics. Two acceptable liner materials may include expanded styrene and polyethylene foam. These liner materials may be used to form a thermal barrier liner having a gas permeable closed cell substrate configuration that is able to equilibrate at working pressure changes.

Referring to FIG. 3, this figure represents how the barrier liner 30 appears when the container has been sealed and pressurized. As shown, the overall thickness of the barrier liner reduces in response to the increased internal pressure within the container. Accordingly, FIG. 2 shows a thickness "a" of the liner that may be somewhat larger than the thickness "b" of the liner when the container is sealed and pressurized. For carbonated beverages, carbon dioxide is the primary gas that fills the container under pressure. Accordingly, the substrate must be permeable to allow passage of the carbon dioxide if used with such carbonated beverages. Within a period of time, the thermal barrier liner will allow passage of the pressurized gas within the container such that the substrate is fully entrained with the pressurized gas. Optionally, liquid nitrogen may be added to the beverage just before sealing to assist in pressure development. In most container filling processes, the end or cap of the container is not attached to the body of the container until the beverage has been added to the container. When the end or cap is attached, a seal is created thus preventing liquid or gas from escaping. Pressure within the container will increase due to a number of factors such as carbonization within the beverage, any added liquid such as nitrogen that will transition to a gas phase, and pasteurization of the beverage by heat treatment. As the thermal barrier liner becomes entrained with the gas, the liner will de-compress as it equilibrates with the internal gas pressure. Some reduction in the area of the headspace of the container may occur by thickening of the liner due to entrainment of the pressurized gas into the liner after the container has been sealed and pressurized. However, normal levels of container pressurization do not have to be significantly altered to account for presence of the liner since the liner even in its fully gas entrained state after pressurization and sealing of the container takes up a minimum volume within the container.

The thermal barrier liner is preferably of a thickness under ambient pressure conditions such that it does not unduly displace the typical amount of the beverage within the container. Thus when the barrier liner expands under ambient pressure conditions, the beverage in the container will not be forced through the opening in the container.

Referring to FIG. 4, this figure represents the point in time when the container has been opened. In response to the reduction in ambient pressure, the cells 34 expand in size to reach equilibrium. Thus, the thickness "c" of the liner is greater than both the thicknesses "a" and "b". The cells maintain this expanded state for a period of time thus providing an effective thermal barrier liner to maintain the beverage at a desired temperature. Typically, the pressure within the container prior to opening is 10 to 35 psi, depending upon carbon dioxide and/or nitrogen levels and temperature of the beverage. By expanding the overall thickness of the barrier liner 30, and without otherwise altering the dimensions of the container or any other parameters, the thermal barrier liner is enhanced simply by the ambient pressure changes between the unopened and opened container.

An added benefit with respect to first embodiment is that when the container is being chilled (when unopened) fast chilling of the beverage may take place since the thermal barrier liner is in its more compressed or thin state, thereby allowing rapid heat transfer away from the container without having to overcome a relatively thickened insulating member.

The permeability of the thermal barrier liner is such that gas is allowed to permeate through the cell walls over a period when under pressure to reach equilibrium, for example, a few hours, but the cell walls are not so permeable that immediate deflation takes place when ambient pressure is reduced. Therefore, the thermal barrier liner will maintain a full thickness for at least a period of time in which a consumer would normally consume the beverage. It is contemplated that it may take up to twenty-four hours for pressurized gas within the container when the container is sealed to permeate through the thermal barrier liner but when the container is opened, it will take at least one hour before the thermal barrier liner reaches equilibrium with the reduced pressure of the environment. Thus, a full, thickened barrier liner is maintained during the time period in which a consumer normally consumes the beverage.

FIGS. 5, 5A and 6 illustrate yet another embodiment of the present invention in the form of a thermal barrier liner 30 comprising a layer of base material 42 interspersed with an additive component 40 such as gas or liquid filled microcapsules. The base material 42 binds to the additive component 40. The additive component 40 can either be a majority component or minority component by volume as compared to the base layer 42. Preferably, the additive component is dispersed randomly throughout the base layer.

One example of an additive component that may be used as a microencapsulated gas includes Expancel®. Expancel® is a commercially available product that includes elastic micro-spheres or microcapsules, roughly ten micrometers in diameter, filled with a small amount of liquid hydrocarbon gas. When heated within a known temperature range, the liquid hydrocarbon gas expands within the micro-spheres causing the micro-spheres to expand to a diameter of nearly four times the size of the liquid state, to approximately forty micrometers. As temperature increases, the gas continues to expand and, thus, the micro-spheres continue to expand in size. The micro-spheres can be used either in an unexpanded liquid state or a pre-expanded gaseous state, depending on application capabilities and the elasticity of the base material 42. With respect to use as an insulation material in the present invention, use of pre-expanded spheres 40 would create a pattern of voids in the base layer.

As mentioned, the microcapsules create voids in the base layer and thereby enhance the thermal barrier capability of the liner. The size and distribution of the voids created by the gas or liquid filled spheres can be selected to provide the desired level of insulation for the container. A greater concentration of micro spheres will produce more voids. The particular gas or liquid selected can be selected to optimize the desired level of insulation.

It is also contemplated that liquid filled micro spheres can be provided so that the liquid changes phase to a gaseous state when the beverage warms during consumption by the consumer. Thus, when the beverage is maintained in its cooled state during storage, the micro-spheres would remain in a liquid state. Referring to FIG. 6, when the container is opened and exposed to the warmer environment, the increase in temperature causes the micro-spheres to transition to a larger diameter as the liquid changes phase to the gas state. Thus, the expansion of the thermal barrier liner in this example is activated by temperature and not by ambient pressure changes. A liquid-gas phase change property for the thermal barrier liner of the present invention may be particularly suited for containers that are not pressurized, such as juice, fruit, or vegetable containers.

For both the first and second embodiments, one acceptable base liner material 42 may include expanded styrene or polyethylene foam. During manufacturing of the liner, increased curing times may be required depending upon the addition of an additive component which may, therefore, increase the curing time.

Figure 7:
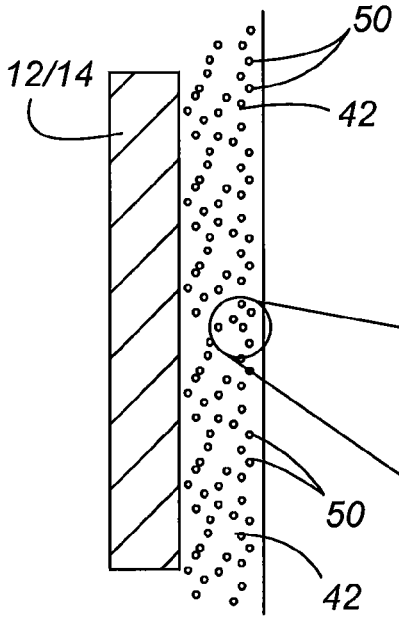
FIG. 7 is an enlarged fragmentary cross section view of a thermal barrier liner in another embodiment of the present invention comprising encapsulated solid phase change materials incorporated within a base liner and showing the thermal barrier liner when the container is sealed and pressurized.
Figure 7A:
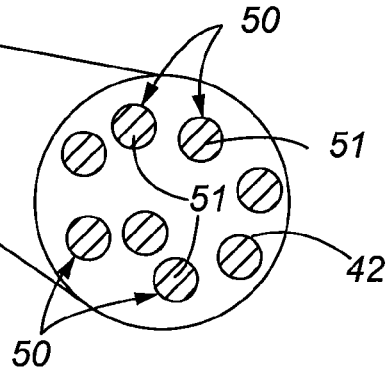
FIG. 7A is a greatly enlarged view of a portion of FIG. 7 showing the barrier liner and the encapsulated solid phase change material within the microcapsules.
Figure 8:
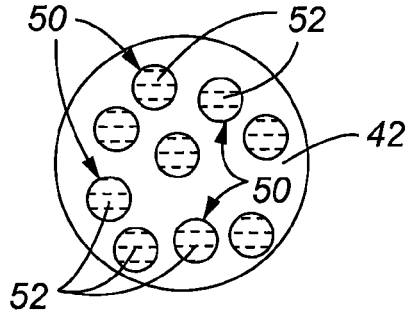
FIG. 8 is another greatly enlarged view of the embodiment of FIG. 7 when the container has been opened and the beverage has warmed to the phase change temperature, showing the phase change material in the microcapsules being in a liquid state after the phase change.

Now referring to FIGS. 7, 7A and 8, in yet another embodiment of the present invention, a thermal barrier liner is provided comprising a base layer 42, and an additive component 50 in the form of encapsulated phase change material. The encapsulated phase change material 50 may also be microcapsules that are interspersed as shown within the base layer 42. One example of phase change material that may be used includes paraffinic hydrocarbons. Another phase change material may include hydrated salts. One commercially amiable type of phase change material may include MPCM-6, a product sold by MicroTek Laboratories, Inc. MPCM-6 is a microencapsulated paraffin wax (specific latent heat of 188.6 J/g) in a polymer shell with a solid to liquid phase change temperature occurring at 6° C. When chilled to below 6° C., the paraffin exists as a solid. As the spheres absorb heat, the encapsulated paraffin rises in temperature until it reaches 6° C. At that temperature, the paraffin continues to absorb heat, but stays at a relatively constant temperature until it has completely transitioned from a solid to a liquid phase. The heat absorbed by the phase change material, also known as latent heat, would otherwise have caused an increase in the temperature of the beverage within the container. The total amount of heat capable of being absorbed by the paraffin wax can be calculated and adjusted by varying the amount of paraffin used within the barrier layer. For example, 25 cc of MPCM-6, which would normally require a minimum liner thickness of one millimeter, absorbs the equivalent heat that would otherwise cause a 5° F. increase in temperature of a 355 cc beverage.

FIGS. 7 and 7A specifically illustrate this third embodiment wherein the container is under pressure and assumedly at a chilled temperature (for example, below 6° C.). FIG. 8 shows the container removed from refrigeration and warmed to a temperature wherein the solid phase change material has transitioned from a solid to liquid state. More specifically, the materials in the microcapsules 50 are shown in FIGS. 7 and 8 as transitioning from a solid state 51 to a liquid state 52.

FIGS. 9, 9A and 10 illustrate yet another preferred embodiment of the present invention. In this embodiment, the thermal barrier liner 30 comprises multiple layers 60 of a lining material wherein voids or gaps 62 exist between each of the layers. The voids or gaps between the layers may be provided in an irregular pattern. As shown in FIGS. 9 and 9A, when the container is under pressure and unopened, the layers 60 form a more compressed, thinner profile. However, as shown in FIG. 10, when the container is opened and ambient pressure is reduced, the gas trapped in the voids between the layers results in an expansion of the liner, thereby enhancing thermal barrier properties of the liner.

This multi-layer liner can be constructed of multiple layers of the same material, or may be made of dissimilar materials. With respect to a single material used, if the single material is layered and sealed in a complex pattern, or applied at different times with different temperatures or viscosities, voids or gas pockets may be formed between layers. With respect to use of dissimilar materials, void areas between the layers may be formed more as a function of the ability of layers to adhere to one another, among other factors.

Unlike conventional liners applied to the interior of containers, it is the intent in the embodiment shown in FIGS. 9 and 10 to install a multi-layered liner wherein intentional voids or gaps are created between the layers of material such that gases may be trapped between the layers. Thus, as mentioned above, the variation of temperatures, viscosities, as well as patterned sealing and/or the use of dissimilar materials can result in the creation of a multi-layered liner having an inconsistent appearance in terms of how the layers adhere to one another. Visually, the liner of this embodiment may appear somewhat wrinkled or may appear as having a roughened surface. These apparent inconsistencies in the liner are a result of the intention to provide gaps or void spaces between the layers of the liner. Thus, this multi-layered liner significantly departs from multi-layered liners, either used internally or externally for containers, wherein the failure to completely adhere one layer to another may be considered a significant defect.

Referring to FIG. 11, a composite thermal barrier liner may be provided by combining one or more of the attributes from the prior embodiments. More specifically, FIG. 11 illustrates a liner including a gas permeable closed cell substrate 32 as well as microencapsulated gas and/or microencapsulated solid-liquid phase change material 40/50 set within a base layer 42.

Figure 12:
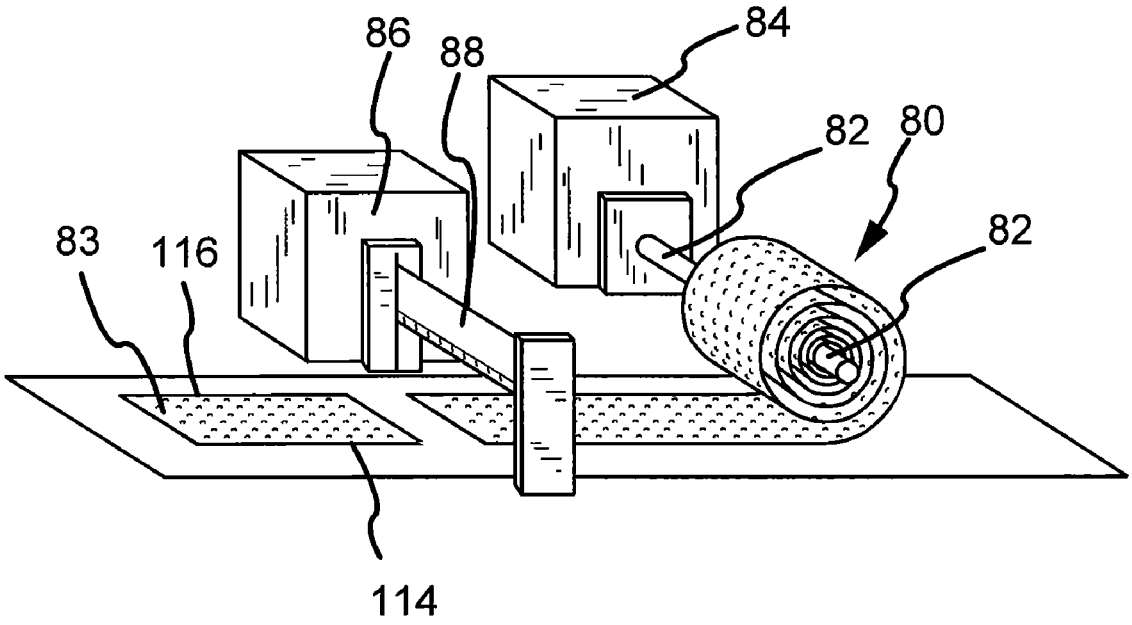
FIG. 12 is a perspective view of a bulk roll of the thermal barrier liner and a schematic view of the equipment that may be used to dispense the liner material for subsequent insertion within individual beverage containers.

FIG. 12 illustrates a bulk roll of liner material 80 as it is dispensed from the roll so that each container being processed can receive a pre-made liner. The liner material is preferably manufactured in an extended continuous strip so that the material maintains a flat or linear position. For example, through an overdriven lamination process, the substrate material has a normally flat or linear configuration. When the material is stored on a bulk roll, the material maintains a spring force such that when the material is released from the roll, the material has a tendency to return to its generally flat, linear configuration. Thus, the liner material has a "stay-flat" memory property that requires no mechanical or physical mechanism to keep the substrate fixed in place with the interior of the container.

Figure 13:
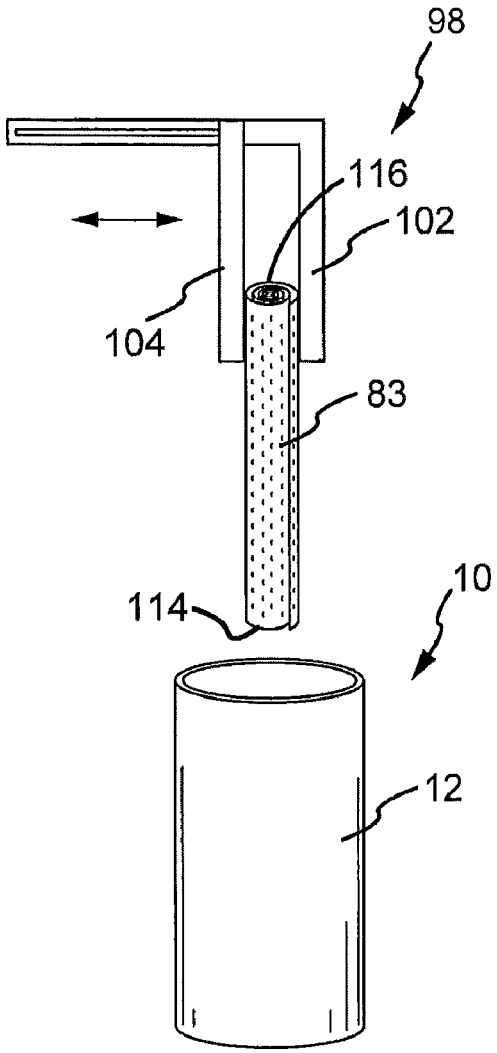
FIG. 13 is a perspective view of a cut piece of the liner material sized to be installed within a container and held by processing equipment that inserts the cut piece into the container.
Figure 14:
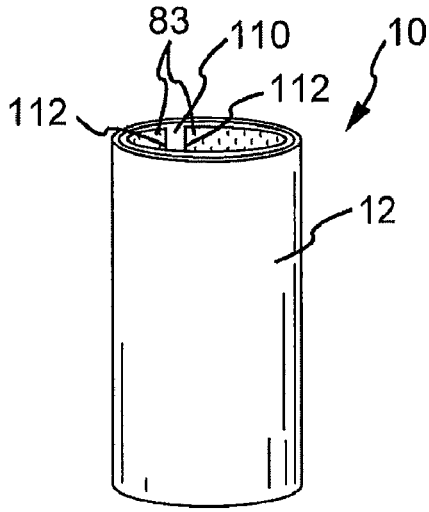
FIG. 14 is a perspective view of the container in which the liner has been installed wherein the barrier material unwinds and thereby places the liner in intimate contact with the interior sidewall of the container.

The bulk roll 80 may be dispensed from a shaft 82 driven by a dispensing device 84. The roll of liner material may be dispensed so that a predetermined length of the material is placed in alignment with a cutting device 86 having a cutting blade 88 that cuts discrete lengths of pieces of the liner material. One cut piece of material 83 is shown adjacent the cutting blade. Referring to FIG. 13, once the piece 83 of liner material has been cut, a handling device 98 is used to secure the piece of liner material and position it so that it may then be inserted within the open top of the container. As shown, the handling device 98 may include a stationary holding element 102 and slideable engaging element 104 that engages the piece of cut liner material in a rolled configuration so that it can be held between elements 102 and 104. The handling device 98 is positioned over the container and inserts the piece of liner material 83 within the container. The slideable engaging element 104 is moved away from the stationary element 102 so that when the inserting element is withdrawn as shown in FIG. 14, the liner material unrolls to contact the interior cylindrical sidewall of the container. More specifically referring to FIG. 14, when the piece of cut liner 83 has been placed in the container, the liner deploys by opening within the interior of the container to contact the cylindrical sidewall. A small gap 110 separates the opposing side edges 112 of the liner material. Preferably, the side edges 112 do not contact one another that might otherwise prevent the liner material from fully deploying to contact the interior sidewall of the container. The interference or friction fit of the liner against the interior sidewall of the container is sufficient enough to maintain its position within the container to overcome normal vibration or shock that the container might experience during distribution or use. For the embodiment of FIG. 2 that utilizes a closed cell substrate and the embodiment of FIG. 12 that utilizes a composite structure including the closed cell substrate, it is desirable to seal the edges of the liner so that liquid does not migrate into the gaps or void spaces between the cells. For the embodiment of FIG. 9, it is also desirable to seal the edges of the liner so that liquid does not migrate into the gaps between the layers. Heat and/or pressure may be applied to the edges of the liner in order to seal the opposing surfaces of the liner at the side edges. The sealing of the opposing side edges 112 may occur just before or just after cutting of the liner. The sealed area can be sized so that the cut may be made along the seal resulting in the trailing side edge 112 of one piece of cut liner being sealed as well as the leading side edge 112 of the next cut piece of liner. The upper edge 116 and lower edge 114 of the liner as viewed when installed (see FIG. 13) may also be sealed, but preferably prior to cutting. More specifically, when the roll of liner material is manufactured, these edges may be sealed.

After the liner has been installed, the top of the container is secured to the sidewall, the container is filled with the beverage, and finally the container is sealed and pressurized.

The thermal barrier liner of the present invention is installed such that it does not degrade or otherwise damage the conventional protective interior liner of the container that is used to prevent contact between the beverage and the metallic sidewall and base. Thus, while the thermal barrier liner makes intimate contact with the conventional interior liner, the thermal barrier liner is not abrasive and otherwise does not produce an adverse affect on the conventional interior liner.

With respect to a preferred thickness of the thermal barrier liner, it shall be understood that none of the embodiments are strictly limited to a specific range but it has been found that a liner between about 1.0 mm to 3.0 mm provides adequate insulation without displacing a quantity of the beverage that adversely affects desired headspace within the container. For the first embodiment, the thermal barrier liner can be between about 0.5 mm and 1.5 mm in thickness when the container is sealed and pressurized, and the thermal barrier liner expands to between about 1.0 mm and 3.0 mm mm when the container is opened and exposed to the environment.

It shall be understood that the thermal barrier liner of the present invention significantly departs from traditional liners used to coat the interior of a container for purposes of preventing spoilage of the beverage in the container. More specifically, conventional liners are formed to create a very smooth, thin, and non-insulating layer. The thermal barrier liner of the present invention by provision of a closed cell substrate, and/or with microencapsulated materials, or a multi-layer liner provides a unique solution for a thermal barrier, and may optionally be made from similar materials as the conventional interior liner.

As also mentioned above, provision of a gas permeable liner that can equilibrate between different ambient pressures allows creation of a thicker insulated layer once the container is opened. Providing this active or size changing barrier liner also has the benefit of allowing the container to be more easily cooled when unopened, yet allows substantially the same amount of beverage to be maintained in the container since the barrier liner occupies a minimum volume when under pressure or when chilled.

With respect to the embodiment of the present invention providing a multi-layered liner, the structure here is intended to provide voids between layers as opposed to conventional liners where the intent is to minimize void areas between the layers in order to maximize the bond between the layers. In fact, many can liners require additives therefore improving the wetting or contact area to maximize bonding between the layers. However, with the present invention, the bonding areas between the layers is reduced to the point where a balance can be achieved between a bond strength such that the layers maintain integrity and remain bound to one another, yet gaps or void areas are formed to allow permeation of gas and subsequent expansion thereby creating an effective thermal barrier liner. Some techniques to promote rough and irregular surface bonding between the layers may include use of high viscosity materials, cold application temperatures, patterned sealing and use of different materials between layers that are not fully miscible.

While the preferred embodiments of the present invention have been shown specifically with respect to a traditional aluminum or steel container, it shall be understood that the thermal barrier liners of the present invention can be incorporated within any type of container to include plastic containers such as PET bottles, or conventional aluminum or steel cans used to contain fruits, vegetables, soups, meat or other products.

Figure 15:
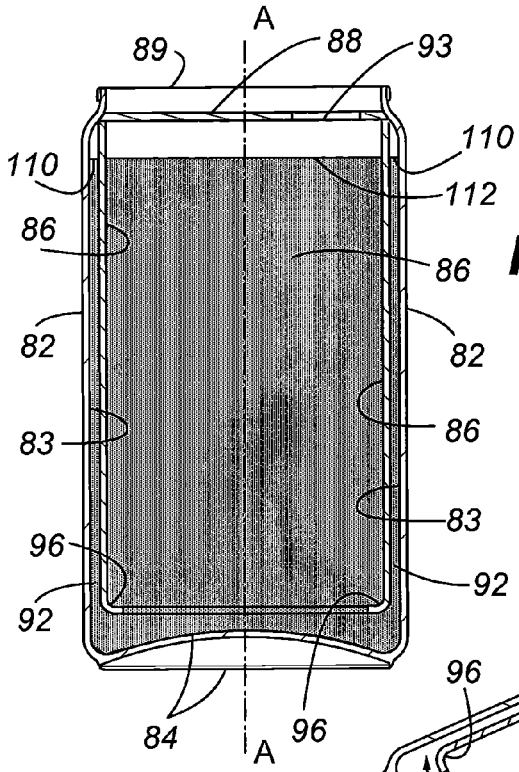
FIG. 15 illustrates a cross section of a container in another embodiment of the present invention in the form of a liner that creates an annular gap between the interior surface of the sidewall and the liner in which an upper end of the liner is sealed to the top of the container and the lower end of the liner is unattached and spaced from the bottom of the container.

FIG. 15 illustrates yet another embodiment of the present invention in which the container incorporates a liner that is spaced from the interior wall of the container thus forming an annular gap 92 between the interior surface of the container and the liner. More specifically, FIG. 15 illustrates a container having a sidewall 82, a base/dome 84, and a top 88 including rim 89. A liner 86 is disposed within the container and is spaced from the interior surface 83 of the sidewall 82. In the embodiment of FIG. 15, the liner 86 is attached to and sealed to the top 88, and lower end of the liner is unattached and is spaced from the base 84. The unattached end of the liner is designated as end 96. The liner may be attached to the top as by an adhesive or heat applied to a liner material that will melt and thus seal itself to the container. For a standard 12 oz, 16 oz, or 20 oz container, the annular gap 92 can be between about 0.5 mm to 1.0 mm in thickness and when filled with air, provides an effective thermal barrier that helps maintain the beverage at a desired temperature. However, this range is not critical and therefore the thickness of the liner can be adjusted for the particular container and beverage to maximize the thermal barrier effect. Optionally, the liner may include a nucleation enhancing material that increases the rate of degassing of the beverage as discussed further below. Carbonated or nitrogenated beverages will therefore produce gas bubbles that will rise and become trapped in the annular gap 92. The additional gas entering the annular space contributes to an increased gas column height in the annular gap.

FIG. 15 illustrates the container when filled and prior to being opened. In this state, the liquid level of the beverage within a chamber of the container bounded by the liner is shown at liquid level line 112. An amount of gas resides in the head space above the liquid line 112. There is also a liquid level line 110 in the annular gap 92, and the liquid level line 110 is approximately the same the level as the liquid line 112 within the chamber of the container.

Figure 16:
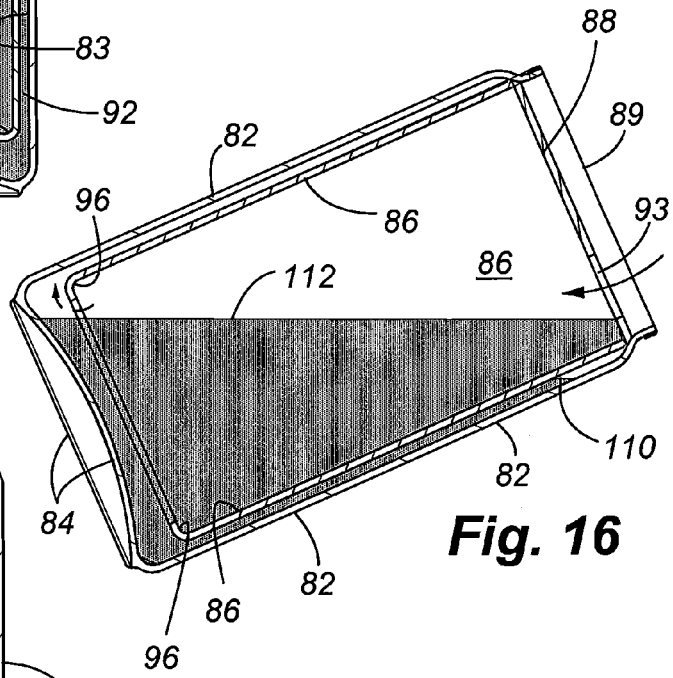
FIG. 16 is another cross section of the embodiment of FIG. 15 illustrating the container being tipped during consumption allowing the annular gap to be exposed to the air.

Referring to FIG. 16, the consumer will tip the container to pour the beverage from the container. When the container is tipped at a sufficient angle, a portion of the unattached end 96 will no longer be submerged in the beverage thus exposing the annular gap to the air.

Figure 17:
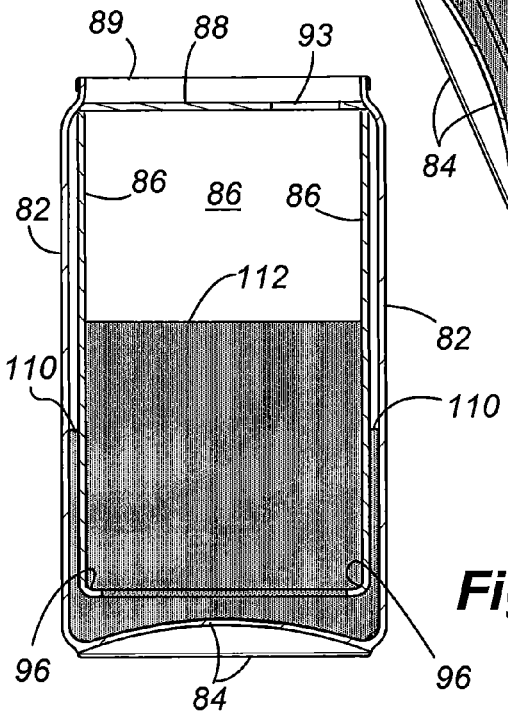
FIG. 17 is another cross section view illustrating the container being returned to an upright position after being tipped and an increased amount of gas in the annular gap creating a thermal barrier.

Referring to FIG. 17, when the consumer returns the beverage to an upright position, the unattached end of the liner is again completely submerged and the air that entered the annular gap while the container was tipped is trapped in the annular gap. The trapped air results in an increased gas column height within the annular gap 92 as shown by the liquid level line 110 being substantially lower than the liquid level line 112.

The distance between the unattached end 96 of the liner and the base of the container can be adjusted to provide an optimal angle at which air is allowed to enter the annular gap for purposes of creating an enhanced thermal barrier.

The embodiment of FIG. 15 also illustrates that the unattached end 96 may be curved such that the end 96 extends radially inward towards a longitudinal axis A-A of the container. This curved end further facilitates an increased amount of gas that can be trapped within the annular gap from gas originating from gas bubbles in the beverage. The curved end reduces the cross-sectional area of the chamber at that location therefore directing the gas bubbles radially outward and into the annular gap. In terms of attaching the liner shown in FIGS. 15-17, one way is to place the upper end of the liner between the upper edge of the sidewall 86 and the rim 89 of the top 88. When the top 88 is seamed to the sidewall 82 after filling the container, the liner 86 would also be secured in place.

Referring to FIG. 18, a modification is shown to the embodiment of FIG. 15, wherein the liner 86 is sealed to the container at the bottom 84 and the unattached end 96 of the liner is disposed at the upper end of the container and spaced from the top 88. FIG. 18 also illustrates the container when filled and prior to being opened by the consumer.

Referring to FIG. 19, when the container is opened and tipped to pour the beverage from the mouth 93, liquid in the annular gap will be removed.

Referring to FIG. 20, when the container is returned to its upright position, the liner acts as a dam to prevent liquid from within the chamber from flooding back into the annular gap. Therefore, an increased amount of air within the annular gap enhances the thermal barrier capability of the container and liner combination.

A number of different materials can be used for the liner since the liner itself does not have to have insulating properties. Examples of acceptable liner materials include polyethylene, polyethylene terephthalate (PET), polypropylene, foil, or laminated foil. Alternatively, the liner material could have its own inherent insulating properties in order to further enhance the thermal barrier characteristics of the container. In such a case, the liner could be made from the materials as discussed above with respect to the other embodiments of the present invention shown in FIGS. 1-12.

In order to keep the liner correctly aligned within the container to maintain a uniformly spaced annular gap, the liner can be stiffened by thermo-formed features in the material. For example if PET is used as the liner material, small beads or bumps/protrusions can be thermo-formed in the material. If a foil material is used, small protrusions can be formed by embossing.

Referring to FIG. 21, another modification is shown to the embodiment of FIG. 15 wherein the liner 86 does not extend substantially parallel with the sidewall 82 but, rather extends at an angle to the sidewall 82 thereby causing an upper portion of the liner 86 to be more closely spaced to the sidewall 82. This closer spacing of the liner 86 results in the annular gap having a smaller volume. Thus, a lesser of amount of air is required to fill the annular gap and this lessened annular gap volume may be advantageous in more quickly establishing a thermal barrier when the beverage is being first consumed. In any event, the particular volume of the annular gap can be selected to allow creation of the thermal barrier that best suites the particular beverage within the container.

Trapped air in a beverage container is problematic and quality standards for most beverages require that only very small amounts of oxygen are permitted. One solution for evacuating air that may be trapped in the annular gap when the container is filled is to alter the filling nozzle so that the beverage is first directed into the annular gap thereby evacuating the gap from air and then filling the remainder of the container. Use of a purge gas such as Nitrogen can also be used to evacuate trapped air in the container. The purge gas can also be directed into the annular gap to evacuate trapped air in the annular gap, as well as directing purge gas in the head space of the container.

Although the liner of FIGS. 15-21 has been illustrated as straight or linear in cross section, it shall be understood that the liner can have other shapes to best insulate the beverage. For example, the middle of the container is typically where a consumer grasps the container, so it may be advantageous to increase the thickness of the annular gap at the middle of the container by providing an annular constriction of the liner at the middle of the liner that extends radially inward toward the longitudinal axis of the container. The increased thickness of the liner at this location further assists in preventing heat transfer from the hand of the consumer.

For the embodiments of FIGS. 15-21, a container is provided in which an automatic insulation feature can be activated by two mechanisms: the first being the normal dispensing action of the beverage by tipping the container in which an increased amount of gas fills the annular gap and second, the optional use of a nucleation enhancing material that increases the rate at which gas is released or de-gassed from the beverage, and this gas is then transported to the annular gap thereby increasing the amount of gas in the annular gap. Because of the insulating characteristics of air, the gap between the sidewall and liner can be very small, yet achieve a very effective thermal barrier for the time in which the consumer will consume the beverage.

Figure 22:
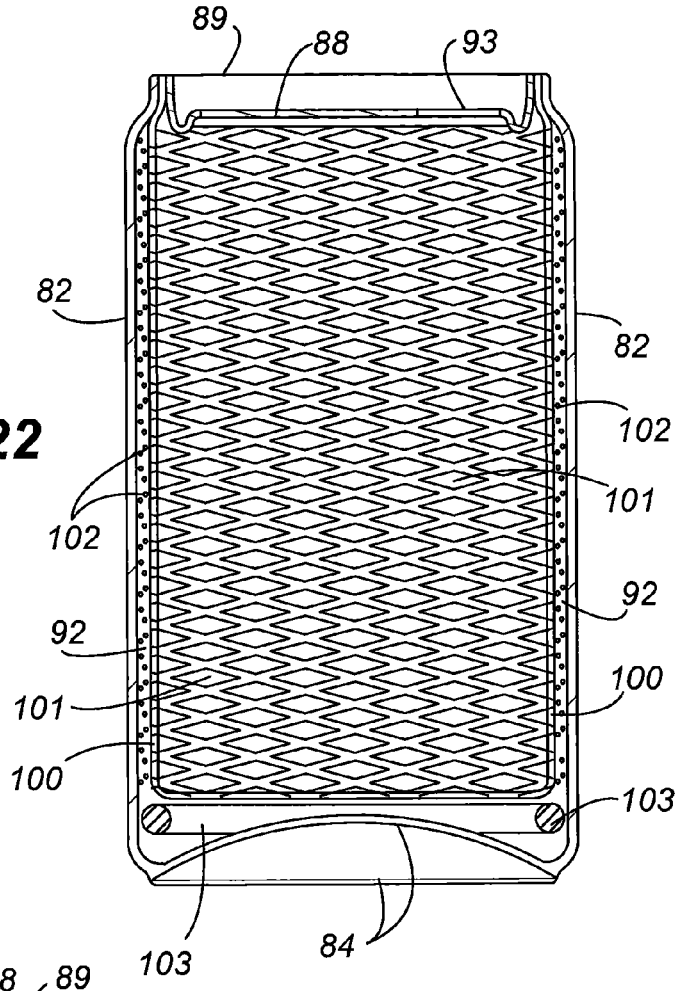
FIG. 22 is a cross section view illustrating a liner in accordance with another embodiment wherein the liner comprises a mesh material.

FIG. 22 illustrates yet another embodiment of the present invention having a liner 100 made of a mesh material. The mesh material has a pattern of interlocking members separated by a corresponding pattern of gaps or openings 101. Like the liners of the previous embodiments, the mesh liner is installed in a concentric fashion within the container to create an annular gap between the interior surface of the container sidewall 82 and the outer or facing surface of the liner 100. The mesh type liner has two functional advantages. The first advantage is that during filling of the container, air is able to vent through the mesh and therefore air is more easily evacuated from the container. In the filling of a beverage container, air must be removed to prevent the air from spoiling the beverage and thus many beverages are purged with nitrogen prior to attaching the top of the container. With the use of a solid liner, it may be more difficult to remove the air during filling. The other advantage of the mesh liner is that an insulating barrier can still be created by bubbles that attach to liner and therefore the liner is still able to provide a large enough air space to thermally insulate the beverage. Some example of materials that can be used to make the mesh liner include woven fibers, open cell foam, and a stretched film that incorporates a plurality of slits or openings to create the voids 101. Because of the geometry of the mesh liner with many different surfaces disposed at various angles, bubbles will have a tendency to attach to the irregular surfaces thereby creating a bubble wall or layer within and around the mesh liner. With the use of a mesh liner, it can also be attached to the sidewall since the thermal barrier created by the bubbles can still occur by the exposed side of the liner that will attract the bubbles.

In each of the embodiments of FIGS. 15-23, the liner material can be especially adapted to nucleate bubbles on the exposed surfaces of the liner thereby either increasing the amount of gas in the annular space or providing a greater concentration of bubbles on the liner. Some examples of how the liner material can be treated or manufactured to encourage an increased rate of nucleation includes (i) providing a textured or roughened liner surface that has a tendency to create greater agitation in the beverage as de-gassing, and this greater agitation results in an increased rate of nucleation of gas in the container; (ii) modifying the surface tension of the liner by corona discharge or by flame treatment that again increases agitation and an increased rate of nucleation; and (iii) providing a molded, hot formed film to create a textured surfaces on the liner that increases agitation and thus enhances nucleation.

Another way in which to increase nucleation would be to incorporate a widget in the container. One example of a known widget used to create a more robust head on a malt beverage includes the use of a small plastic nitrogen filled sphere having a very small hole formed on the sphere. The sphere is typically added to the container before the container is sealed and the sphere floats with the hole just below the surface of the beverage. Before the container is sealed, a small shot of liquid nitrogen is added to the beverage. Pressure increases in the container as the liquid nitrogen evaporates, and the beverage is slowly forced into the sphere thereby compressing the nitrogen gas in the sphere. When the container is opened, the compressed gas in the sphere quickly forces the beverage through the hole causing agitation of the beverage which nucleates the gas in the beverage creating bubbles. The widget could be formed in a ring shape and placed in the annular gap. The widget would therefore provide a way of directing the bubbles 102 in the annular gap. FIG. 22 shows an example widget 103 fitted in the bottom of the container and within the annular gap. The widget 103 is ring or donut shaped and rests on the bottom/dome 84. The widget is placed so that it is aligned under the annular gap 92. The widget has an outer surface or shell that covers the hollow interior. A small hole in the widget allows the compressed gas in the widget to force the beverage out as explained above.

Figure 23:
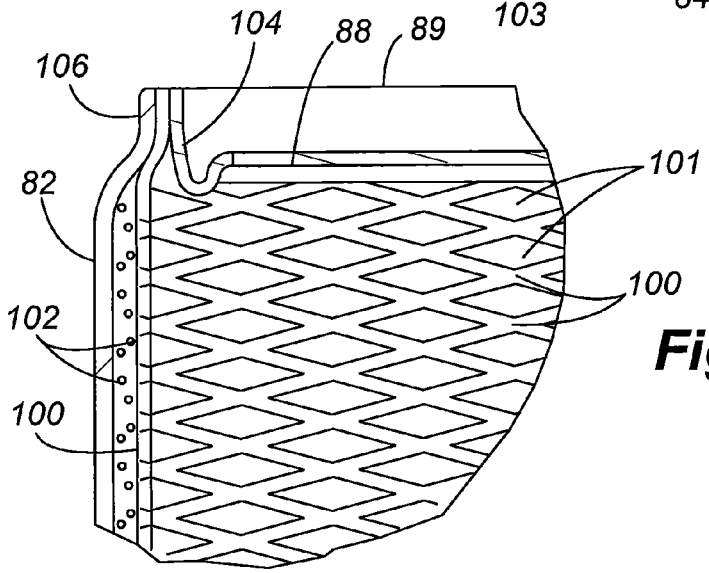
FIG. 23 is a greatly enlarged portion of FIG. 22 showing one example of how the liner can be attached to the container.

Referring to FIG. 23, one technique is illustrated for attaching the liner to the container. As shown, the liner can be placed between the neck 106 of the sidewall 82 and the chuck wall 104 of the top end 88. When the chuck wall and neck are seamed to seal the beverage, the upper end of the liner is squeezed and trapped thus holding the liner in the concentric configuration within the container. Although the bubbles 102 are only shown in the gap between the sidewall 82 and the liner 100, it shall be understood that the bubbles would form a layer on the liner 100 and would fill in some of the gaps/openings 101. The layer of bubbles 102 have not been shown on all portions of the liner for purposes of clarity.

While the present invention has been discussed for use in keeping beverages cool, it shall also be understood that the present invention can also be used to thermally insulate a beverage intended to be served at room temperature or warmer. For the first embodiment of the present invention incorporating the closed cell substrate that is capable of thermally insulating a container by only changes in pressure, this embodiment can certainly be used for those beverages that are intended to be served at room temperature or warmer.

The automatic activation of the thermal barrier liner under variable pressure or temperature conditions makes the thermal barrier liner ideal in those commercial applications where the beverages may be stored under pressure, such as the case for carbonated soft drinks and beer.

Because the thermal barrier liner of the present invention may be installed by mechanically inserting the liner in an unfinished container, it is unnecessary to significantly alter or otherwise modify known beverage packaging machinery or processes.

While the present invention has been described with respect to various preferred embodiments, it shall be understood that various other changes and modifications to the invention may be made, commensurate with the scope of the claims appended hereto.

What is claimed is:

1. A method of manufacturing an insulated container, said method comprising the steps of:

providing a beverage container including a sidewall and a base connected to the sidewall;

providing a thermal barrier made of a sheet of material; and mechanically inserting the thermal barrier material in the container and deploying the material, by unrolling to contact an interior surface of the container to form an interior liner; and wherein a closed cell substrate is incorporated in the thermal barrier material, and the thermal barrier material is gas permeable such that voids in the closed cell substrate equilibrate with ambient pressure conditions and such voids change size based on changes in ambient pressure conditions as compared to pressure conditions in the barrier material.

2. A method, as claimed in claim 1, wherein:

said method further comprises inserting the thermal barrier material in an open top of the container, and then securing a top of the container to an upper portion of the sidewall.

3. A method, as claimed in claim 1, wherein:

said thermal barrier material is secured by a handling device that maintains said thermal barrier material in a rolled configuration prior to inserting the material in the container.

4. A method, as claimed in claim 1, wherein: said thermal barrier material includes:

a base material, and a plurality of microcapsules containing gas dispersed in said base material, said microcapsules changing shape based upon ambient pressure conditions wherein said microcapsules have a smaller size when placed under pressure when the container is sealed and pressurized, and wherein the microcapsules expand when the container is opened and the thermal barrier liner is exposed to the environment, said thermal barrier liner having a surface in contact and adhered to an interior surface of said sidewall and said base.

5. A method, as claimed in claim 1, wherein: said thermal barrier material comprises a base material and a plurality of microcapsules containing phase change material therein, said microcapsules being dispersed in said base material, wherein said microcapsules absorb heat upon a temperature increase within the interior of the container and the phase change material changes from solid to liquid.

6. A method, as claimed in claim 1, wherein: said thermal barrier material liner comprises at least a first layer of barrier material contacting the interior surface, and at least a second layer secured to said at least first layer wherein gaps are formed between the first and second layers and gas occupying the gaps.

7. A method, as claimed in claim 1, wherein: said thermal barrier material comprises a composite structure, said composite structure comprising (i) a closed cell substrate having a plurality of cells defining voids, said closed cell substrate being gas permeable to allow gas to pass through the cells based upon ambient pressure changes within the interior of the container, and (ii) a plurality of microcapsules dispersed in said closed cell substrate, said plurality of microcapsules including at least one of gas filled microcapsules and phase change material filled capsules.

8. A method, as claimed in claim 1, wherein:

said thermal barrier material has a thickness that changes based upon changes in ambient pressure conditions.

9. A method, as claimed in claim 1, wherein:

said thermal barrier material is made of a thermoplastic material.

10. A method, as claimed in claim 1, wherein:

said thermal barrier material is elastic.

11. A method, as claimed in claim 1, wherein:

said thermal barrier material is between about 0.5 mm and 1.5 mm in thickness when the container is sealed and pressurized, and the thermal barrier material expands to between about 1.0 mm and 3.0 mm when the container is opened and exposed to the environment.

12. A method, as claimed in claim 1, wherein:

cells of said cell substrate are randomly dispersed in said substrate and said cells have a plurality of different sizes.

13. A method, as claimed in claim 12, wherein:

said cells are substantially uniformly dispersed in the substrate.

14. A method, as claimed in claim 12, wherein:

said cells have different sizes.

15. A method, as claimed in claim 1, wherein:

said thermal barrier material comprises at least a first layer of barrier material contacting the interior surfaces, and at least a second layer secured to said at least first layer wherein gaps are formed between the first and second layers and gas occupying the gaps.

* * * * *